US009243852B2

(12) United States Patent
Hindi

(10) Patent No.: US 9,243,852 B2
(45) Date of Patent: Jan. 26, 2016

(54) ADJUSTABLE HEAT EXCHANGER

(71) Applicant: KING ABDULAZIZ UNIVERSITY, Jeddah (SA)

(72) Inventor: Sherif Shawki Zaki Hindi, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 417 days.

(21) Appl. No.: 13/794,617

(22) Filed: Mar. 11, 2013

(65) Prior Publication Data

US 2014/0251578 A1 Sep. 11, 2014

(51) Int. Cl.

| | |
|---|---|
| ***F28D 11/00*** | (2006.01) |
| ***F28D 11/02*** | (2006.01) |
| ***F28D 11/06*** | (2006.01) |
| ***F28D 11/08*** | (2006.01) |
| ***F28F 1/04*** | (2006.01) |
| ***F28F 5/00*** | (2006.01) |
| ***F28F 5/02*** | (2006.01) |

(52) U.S. Cl.

CPC ..... *F28F 5/00* (2013.01)

(58) Field of Classification Search

CPC ..... F28D 11/00; F28D 11/02; F28D 11/06; F28D 11/08; F28D 7/163; F28D 7/1669; F28F 1/003; F28F 1/04; F28F 5/00; F28F 5/02; F28F 2013/008

USPC ..... 165/86, 88–90, 96

See application file for complete search history.

(56) References Cited

U.S. PATENT DOCUMENTS

| | | | | |
|---|---|---|---|---|
| 3,500,899 | A * | 3/1970 | Shane, Jr. | 165/277 |
| 3,650,319 | A * | 3/1972 | Boon | 165/88 |
| 4,271,682 | A * | 6/1981 | Seki | 62/354 |
| 4,419,980 | A | 12/1983 | Leary et al. | |
| 4,556,105 | A | 12/1985 | Boner | |
| 4,771,823 | A * | 9/1988 | Chan | 165/61 |
| 5,178,102 | A | 1/1993 | Kehrer et al. | |
| 5,335,143 | A * | 8/1994 | Maling et al. | 361/694 |
| 5,632,159 | A * | 5/1997 | Gall et al. | 62/354 |
| 6,050,333 | A | 4/2000 | Albaroudi | |
| 6,908,533 | B2 | 6/2005 | Zebuhr | |
| 6,959,554 | B1 * | 11/2005 | Shirron et al. | 62/3.1 |
| 7,062,913 | B2 | 6/2006 | Christensen et al. | |
| 2010/0282451 | A1 | 11/2010 | Singh et al. | |

FOREIGN PATENT DOCUMENTS

| | | | |
|---|---|---|---|
| DE | 974583 C | * | 2/1961 |
| GB | 882760 A | * | 11/1961 |

* cited by examiner

*Primary Examiner* — Allen Flanigan

*Assistant Examiner* — For K Ling

(74) *Attorney, Agent, or Firm* — Richard C. Litman

(57) ABSTRACT

The adjustable heat exchanger provides precise control of oven temperature in a pyrolysis reaction. The heat exchanger includes two sets of hollow non-circular discs, the discs of a movable set being interleaved with the discs of a stationary set. A first working fluid circulates through a heat source oven and through the hollow stationary discs, and a second working fluid circulates through the hollow rotating discs and a pyrolysis oven. The two fluids do not mix with one another, but are always completely separate from one another. Heat transfer depends upon the relative surface area of the rotary discs interleaved between the stationary discs. Minimum heat transfer occurs when the rotary discs are rotated to a position clear of the stationary discs, and maximum heat transfer occurs when the rotary discs are completely interleaved with the stationary discs.

18 Claims, 9 Drawing Sheets

ADJUSTABLE HEAT EXCHANGER

BACKGROUND OF THE INVENTION

1. Field of the Invention

The present invention relates generally to devices for controlling the temperature of pyrolysis reactions, and particularly to an adjustable heat exchanger having a plurality of alternating discs for transferring heat from one set to the other.

2. Description of the Related Art

Pyrolysis is the process of chemically breaking down or altering a substance by heat in an essentially oxygen-free environment. Pyrolysis is used in the manufacture of various materials and in the production of lighter fractions from crude oil, as well as in other industries. The process often requires very precise control of the temperature during the pyrolysis process in order to achieve the specific chemistry of the desired end result.

To date it has been extremely difficult to achieve such precisely controlled temperatures (other than in electric ovens), particularly in fluid-based ovens required for successful pyrolysis. Thus, an adjustable heat exchanger solving the aforementioned problems is desired.

SUMMARY OF THE INVENTION

The adjustable heat exchanger provides precise heat transfer, and therefore temperature control, from a high temperature heat source oven to a controlled temperature pyrolysis oven. The heat exchanger has a plurality of fixed discs and a plurality of rotating discs, which are interleaved in an alternating array. Each disc is hollow, and heat transfer fluid circulates therethrough. A first heat transfer fluid circulates from the high temperature heat source oven through the fixed discs, and a second heat transfer fluid circulates through the rotating discs and pyrolysis oven. The two fluids do not mix with one another, but are kept completely separate. Separate pumps are used to circulate the fluids through their respective discs and ovens. Any suitable fluid may be used as the working fluids in the two disc assemblies and their ovens, but helium gas is a preferred fluid, while a lithium-lead compound has been used in certain specialized heat transfer apparatus and applications.

The two sets of discs are semicircular in shape, and rotation of the rotating discs results in greater or less surface area being exposed beyond the stationary discs. This results in lesser or greater heat transfer between the stationary discs and the rotary discs, respectively. Since the discs are semicircular, the rotation of the rotary discs to a position 180° opposite the fixed discs results in maximal spatial separation between the fixed and rotating discs and minimal heat transfer between the two. Partial rotation of the rotating discs between the fixed discs results in somewhat greater heat transfer, and continued rotation of the rotary discs completely between the fixed discs results in maximum heat transfer from the fixed discs to the rotary discs, and thus to the pyrolysis oven.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The adjustable heat exchanger provides precise temperature control for pyrolysis reactions involving the breakdown of various organic compounds in a reducing atmosphere. The heat exchanger is disposed between a heat source oven providing relatively higher heat and a pyrolysis oven. Adjusting the heat exchanger provides precise heat transfer from the heat source oven to the pyrolysis oven for precise control of the reactions taking place within the pyrolysis oven.

Figure 1:
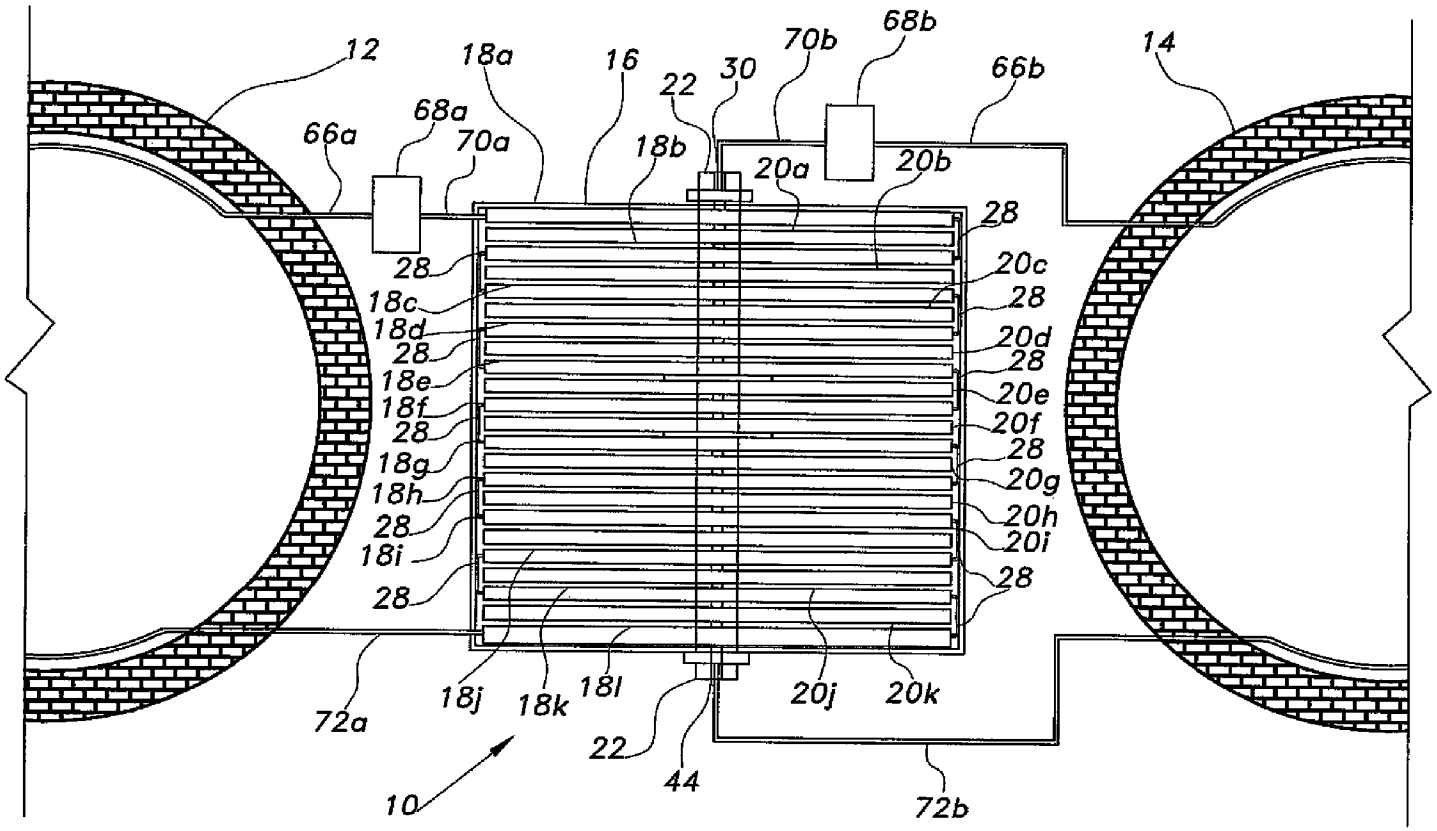
FIG. 1 is a diagrammatic view of an adjustable heat exchanger according to the present invention, illustrating its general configuration and connection to input (high temperature sink) and output (pyrolysis) ovens.

FIG. 1 of the drawings provides a schematic view of an exemplary installation of the adjustable heat exchanger 10 in an installation having a first oven or heat source oven 12 and a second oven or pyrolysis oven 14. The ovens 12 and 14 are shown partially in FIG. 1 in order to provide a reasonable scale, but it will be understood that each oven 12 and 14 is a closed unit when in operation. Similarly, the heat exchanger 10 is shown open, but it will be understood that it is completely enclosed by a thermally insulated housing 16 when in operation.

The adjustable heat exchanger 10 contains a first plurality of fixed hollow discs, e.g., discs 18*a* through 18*l*, in a parallel array to one another. The fixed discs 18*a* through 18*l* are spaced apart from one another to allow the placement of a movable disc between each of the fixed discs. A second plurality of mutually parallel, movable hollow discs, e.g., 20*a* through 20*k*, is disposed in a radial array along a rotating shaft 22. Other than being fixed to a rotating shaft 22, the movable discs 20*a* through 20*k* are substantially identical to the fixed discs 18*a* through 18*l*. The movable discs 20*a* through 20*k* are also spaced apart from one another to allow placement of the movable discs between the fixed discs 18*a* through 18*l*, so that the fixed discs 18*a* through 18*l* and the movable discs 20*a* through 20*l* are interleaved with one another in an alternating array when the movable discs 20*a* through 20*l* are rotated between the fixed discs 18*a* through 18*l*.

The spacing between the alternating fixed discs 18*a* through 18*l* and movable discs 20*a* through 20*k* is preferably quite close, leaving just sufficient room or space to preclude physical contact between the fixed and moving discs. This greatly improves the heat transfer between the fixed and moving discs. The discs 18*a* through 18*l* and 20*a* through 20*k* are preferably semicircular in form as shown in the various drawings, but may be any suitable shape or form, so long as rotation of the movable discs 20*a* through 20*k* relative to the stationary discs 18*a* through 18*l* results in variation in the closely adjacent surface area between the stationary and movable discs in order to adjust the heat transfer therebetween. It will be seen that the twelve fixed discs 18*a* through 18*l* and the eleven movable discs 20*a* through 20*k* are exemplary in number, and more or fewer discs may make up each set of fixed and rotating discs.

Figure 2:
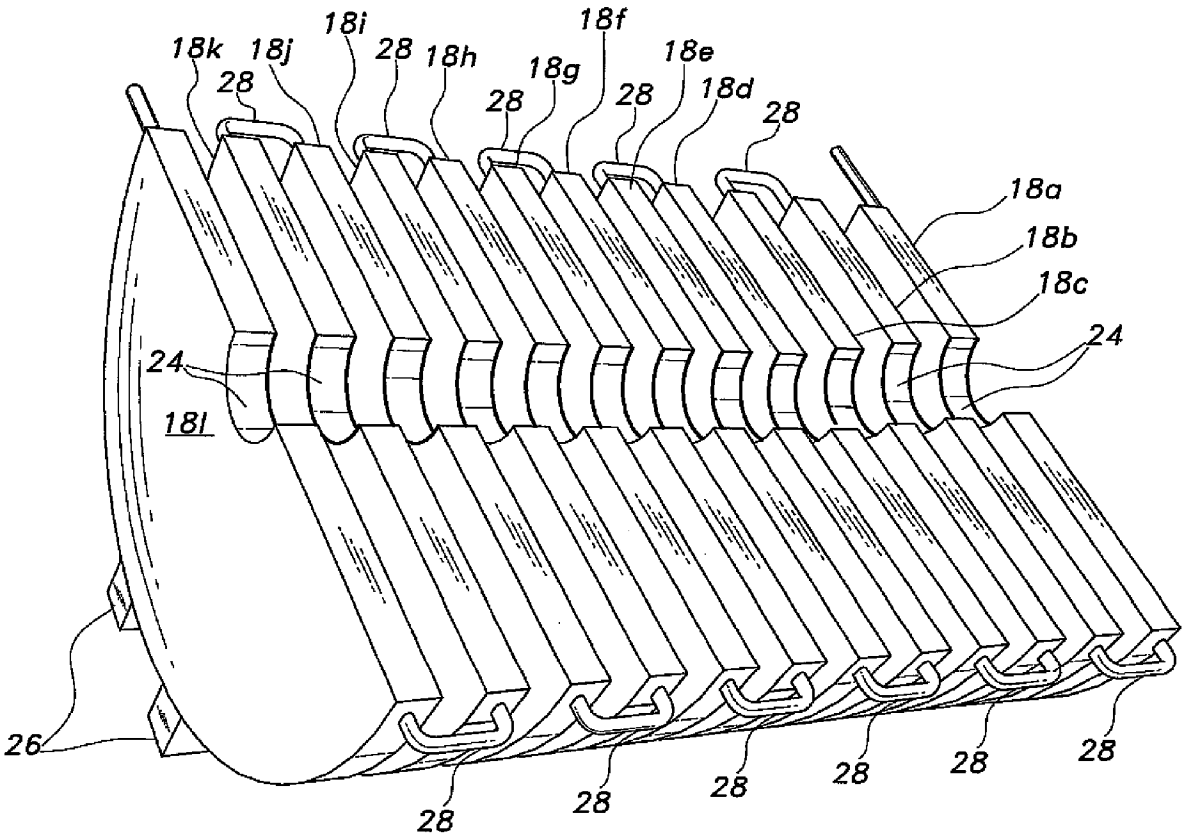
FIG. 2 is a perspective view of the stationary disc portion of the adjustable heat exchanger of FIG. 1.

FIG. 2 provides a detailed perspective view of the fixed discs 18*a* through 18*l*. Each of the fixed discs includes a central channel 24 therein. The aligned channels 24 of the discs 18*a* through 18*l* provide for the placement of the rotary shaft 22 therein. The shaft 22 is illustrated in FIGS. 1, 3, 5, and 6A through 6D of the drawings. The discs 18*a* through 18*l* are supported by legs 26, which, in turn, rest within the housing 16, shown in FIGS. 1 and 5 of the drawings. A plurality of peripherally disposed interconnecting tubes 28 extend between adjacent fixed discs 18*a* through 18*l*, and connect each of the fixed discs in sequence. That is to say, the first fixed disc 18*a* is fluidly connected directly to the second fixed disc 18*b*, the second fixed disc 18*b* communicates fluidly with the third disc 18*c*, and so on, in sequence. Thus, fluid flowing through the first fixed disc 18*a* must flow through the second fixed disc 18*b* in order to reach the third fixed disc 18*c*, etc.

Figure 3:
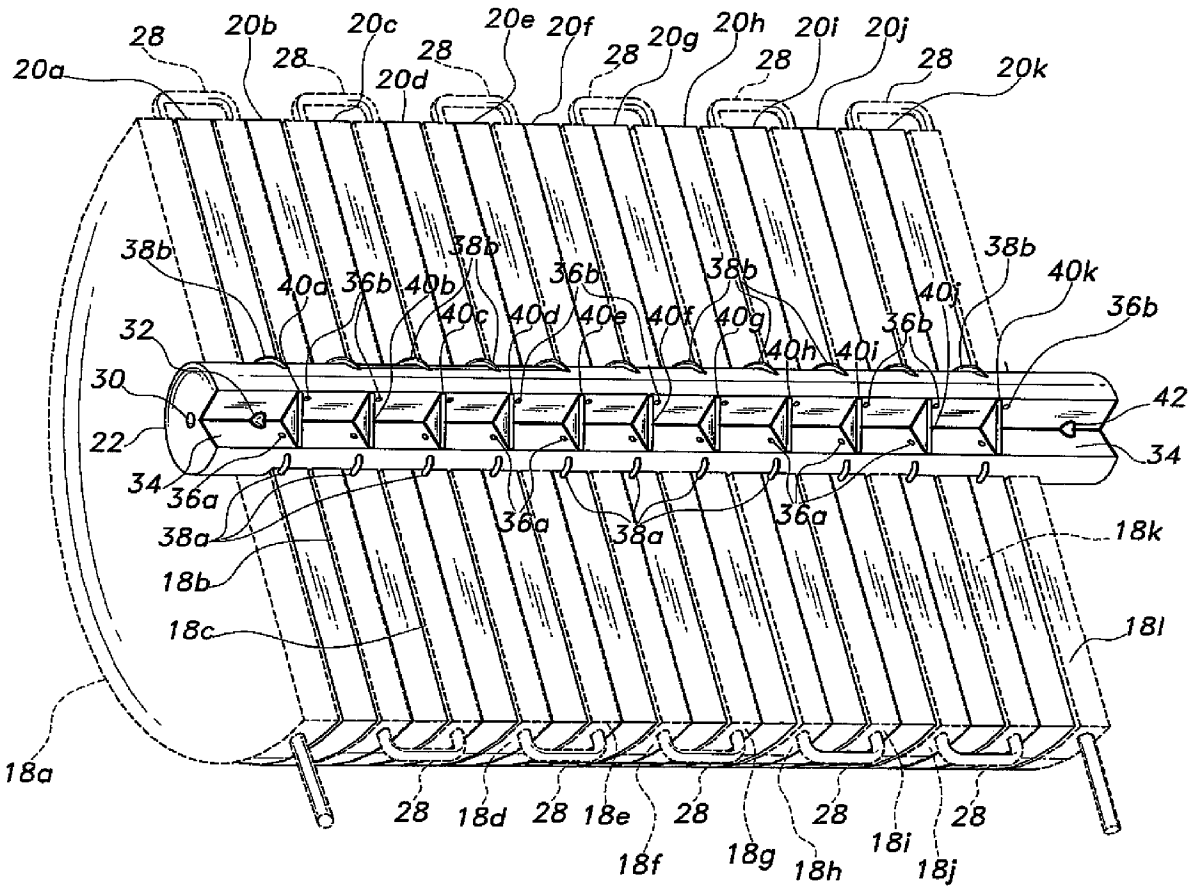
FIG. 3 is a perspective view of the rotating disc portion of the adjustable heat exchanger according to FIG. 1, the stationary disc portion being shown in broken lines.

A similar sequential flow path is provided for the rotary discs 20*a* through 20*k*, as shown in FIG. 3 of the drawings. The various rotary discs 20*a* through 20*k* are affixed to the shaft 22, and extend radially therefrom to rotate with the shaft. The heat transfer fluid flows into an axial entry port 30 at one end of the shaft 22, and thence through a radially disposed passage 32 into a notch or channel 34 formed axially along the length of the shaft. A plurality of lateral ports 36*a* and 36*b* and corresponding transfer tubes 38*a* and 38*b* allow the heat transfer fluid to flow from the shaft channel 34 to each of the rotary discs 20*a* through 20*k*, and back from each of the discs into the channel 34. A plurality of channel baffles 40*a* through 40*k* extend laterally across the shaft channel 34 to prevent flow of the heat transfer fluid along the channel 34 without passing through each of the discs 20*a* through 20*k* in sequence.

Thus, the heat transfer fluid enters the entry port 30 of the shaft 22 and flows through the inlet passage 32 into the first or entry end of the channel 34. The first baffle 40*a* precludes axial travel of the fluid along the channel 34, so the fluid must flow into the lateral passage 36*a* and corresponding transfer tube 38*a* to the first rotary disc 20*a*. After the fluid flows through the first rotary disc 20*a*, it passes through the transfer tube 38*b* and lateral passage 36*b*, which is on the opposite side of the first baffle 40 from the first lateral passage 36*a*. As the fluid cannot flow back to the first lateral passage due to the first baffle 40*a*, it must flow into the second lateral passage 36*b* and its transfer tube 38*b* to flow into the second rotary disc 20*b*. After flowing through the second rotary disc 20*b*, the fluid flows through the transfer tube and lateral passage into the next channel chamber defined by the first and second baffles 40*a* and 40*b*. The process continues with the heat transfer fluid flowing through each of the rotary discs 20*a* through 20*k*, finally flowing from the last disc 20*k* through the last transfer tube 38*b* and outlet passage 36*b* into the channel 34 between the last baffle 40*k* and the radial exit passage 42 to depart the axial exit port 44 (shown in FIGS. 1 and 5) of the shaft 22.

Figure 4:
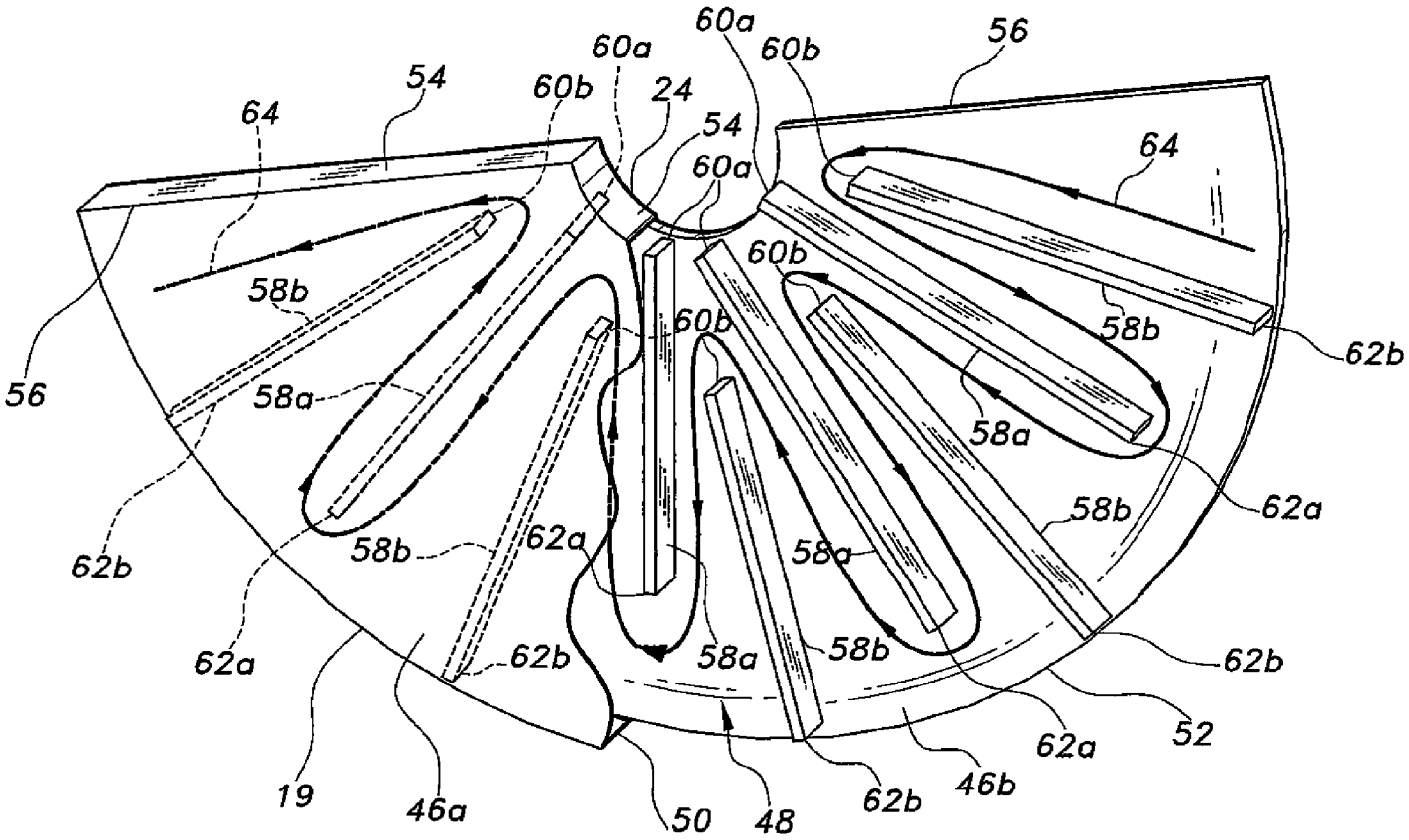
FIG. 4 is a perspective view of an exemplary heat exchanger disc of the adjustable heat exchanger of FIG. 1, a portion of one disc face being broken away to show the internal baffle configuration.
Figure 5:
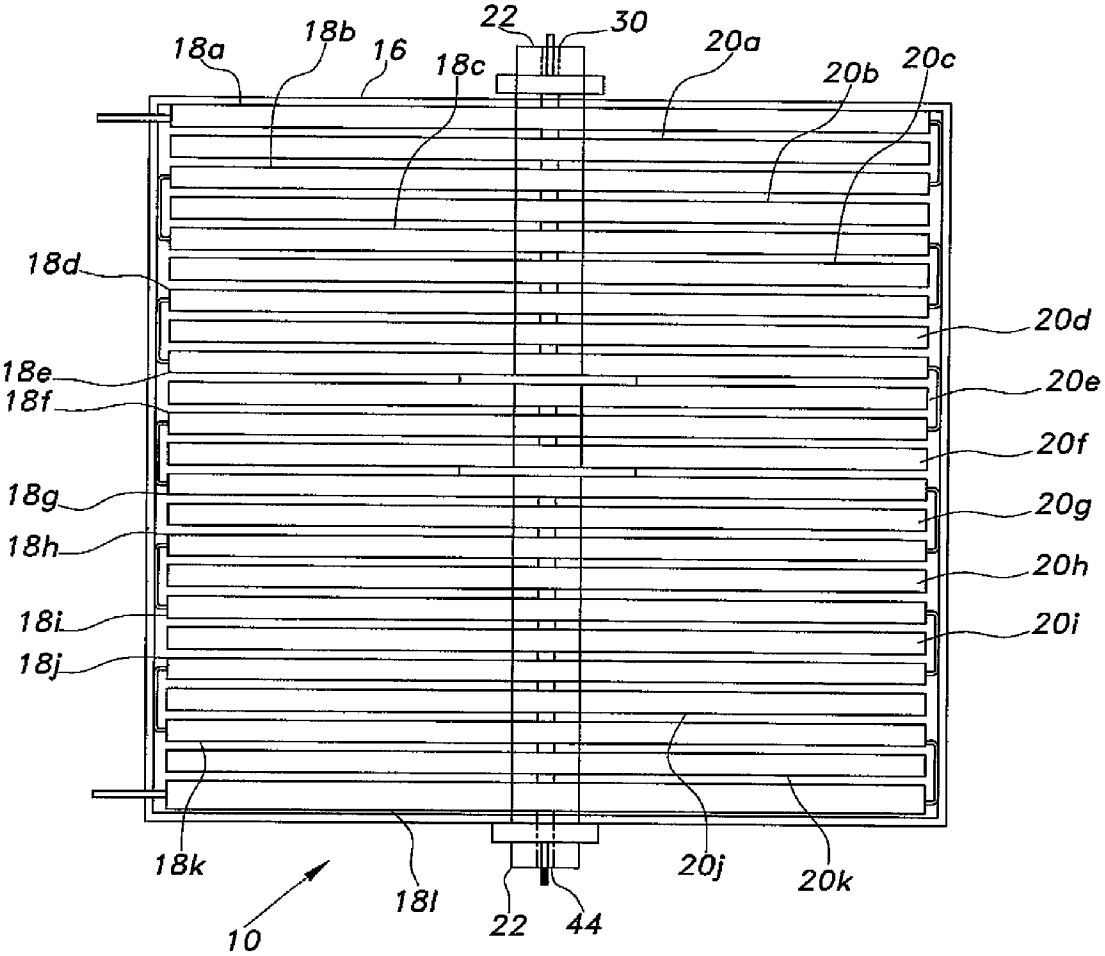
FIG. 5 is a top plan view of the adjustable heat exchanger of FIG. 1, illustrating the relationship between the alternating stationary and rotating discs and the interconnection between the discs of each set.

The internal structure of an exemplary one of the discs 18*a* through 18*l* and 20*a* through 20*k* is illustrated in FIG. 4 of the drawings. This exemplary disc is designated as disc 19 in order to avoid implication that it is a specific member of either the set of fixed discs or rotating discs. However, the structure of the disc 19 of FIG. 4 is substantially identical to the structures of each of the fixed discs 18*a* through 18*l* and each of the rotating discs 20*a* through 20*k*. All of the fixed and rotary discs, as exemplified by the disc 19, comprise a thin hollow member having mutually opposed, parallel first and second plates 46*a* and 46*b* defining an interior 48. The two plates 46*a* and 46*b* are surrounded by a semicircular outer wall 50 that surrounds the outer peripheries 52 of the plates and a wall 54 that extends across the diametric inner peripheries 56 of the two plates 46*a*, 46*b* and the central channel 24. The interior 48 of this closed structure only communicates with the external environment by means of the interconnecting transfer tubes 28 (in the case of the fixed discs 18*a* through 18*l*) or the inlet and outlet transfer tubes 38*a* and 38*b* to and from the shaft 22 (in the case of the rotating discs 20*a* through 20*k*).

A plurality of baffles are installed within the interior 48 of each of the discs in a radial array. The baffles guide or control the flow of the heat exchange fluid through the discs. All of the baffles are identical to one another, but are designated differently according to their positions within the disc. Each baffle 58*a* of a first plurality of baffles has its inner end 60*a* adjacent the inner periphery of the disc, specifically the portion of the wall 54 forming the channel 24, its opposite outer end 62*a* being spaced inward from the outer circumferential wall 50 and outer peripheries 52 of the two plates 46*a*, 46*b*. Each baffle 58*b* of a second plurality of baffles has its inner end 60*b* spaced apart from the inner portion of the wall 54 forming the channel 24 of the disc, its opposite outer end 62*b* being adjacent to the outer circumferential wall 50 and outer peripheries 52 of the two plates 46*a*, 46*b*.

The baffles 58*a* and 58*b* are interleaved with one another in an alternating array in the disc, e.g., a second baffle 58*b*, a first baffle 58*a*, another second baffle 58*b*, another first baffle 58*a*, etc. In this manner, heat exchange fluid entering at one edge of the disc flows generally radially inward and outward between the baffles 58*a* and 58*b* in a sinusoidal path 64 (this path represents the working fluid, e.g., helium, lithium-lead compound, etc.), to exit the disc opposite its entrance point. The baffle arrangement illustrated in the example of FIG. 4 is exemplary of one of the fixed discs 18*a* through 18*l* where the fluid enters and exits the outer edge of the disc, but it will be seen that the reversal of the locations of the baffles 58*a* and 58*b*, i.e., relocating the baffles 58*a* to the locations illustrated for the baffles 58*b* and vice versa, would provide the desired flow path when the flow enters and exits the disc adjacent the channel 24, as in the case of the rotating discs 20*a* through 20*k*.

FIGS. 6A through 6D illustrate the variable relationship between the fixed and rotary discs in providing heat transfer between the two types of discs. In FIGS. 6A through 6D the single fixed disc illustrated is designated as disc 18 and represents all of the discs 18*a* through 18*l*, while the single rotating disc is designated as disc 20 and represents all of the rotating discs 20*a* through 20*k*. The various internal baffles are shown in broken lines in both discs 18 and 20, and the rotating disc 20 is stippled to differentiate it from the fixed disc 18 throughout FIGS. 6A through 6D. The housing 16 is not shown in FIGS. 6A through 6D for clarity in the drawings.

Figure 6A:
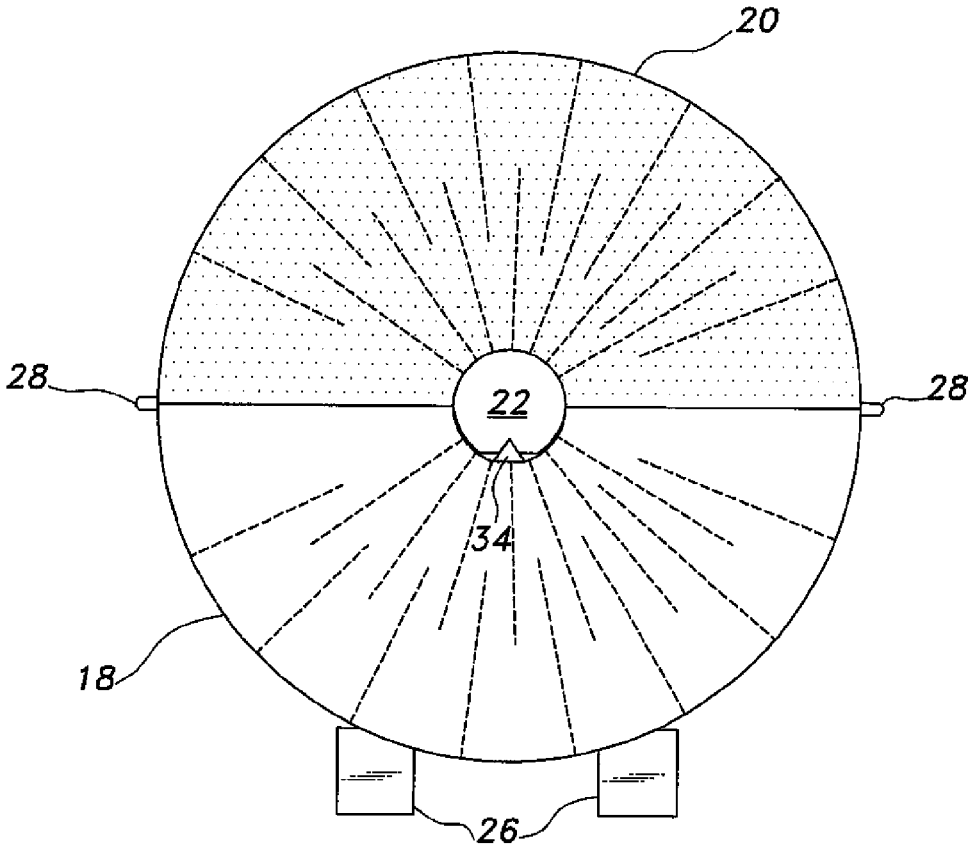
FIG. 6A is an end view of the adjustable heat exchanger of FIG. 1, showing the rotary discs rotated clear of the stationary discs for minimal heat transfer therebetween.
Figure 6B:
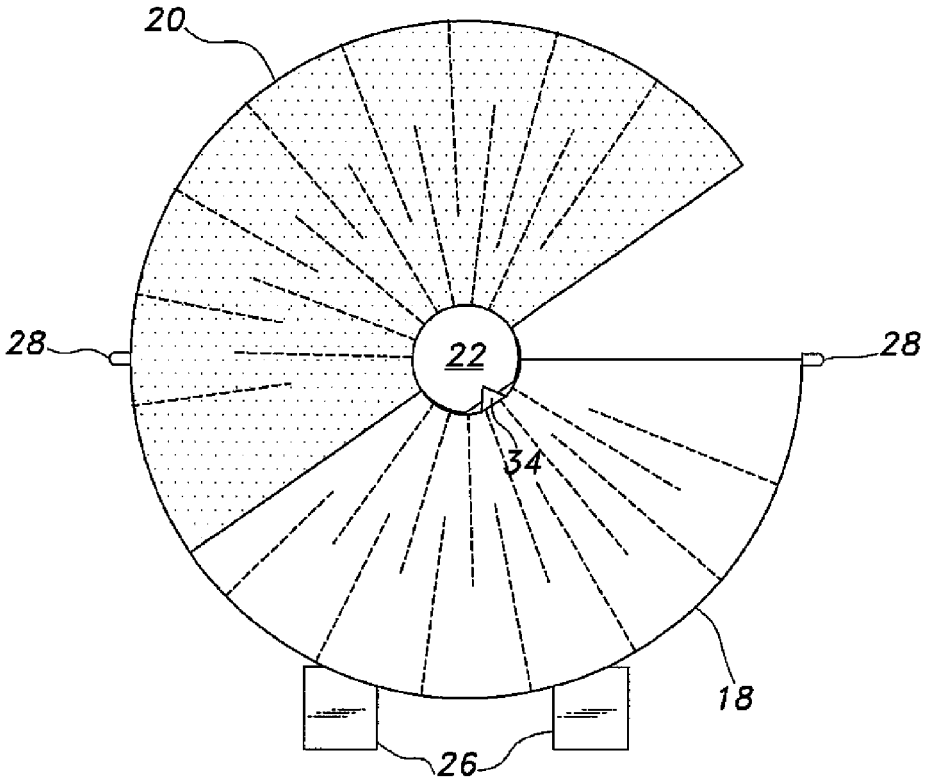
FIG. 6B is an end view of the adjustable heat exchanger of FIG. 1, showing the rotary discs partially interleaved with the stationary discs for partial heat transfer therebetween.

In FIG. 6A, the rotating disc 20 is shown rotated 180° from the fixed disc 10, so that there is no engagement or interleaving between the two discs. This results in minimal heat transfer between the two discs. However, in FIG. 6B, the rotating disc 20 is shown rotated counterclockwise approximately 30°, thereby engaging about one-sixth of the surface of the rotating disc 20 adjacent the surface of the fixed disc 18 (or, interleaving about one-sixth of the surfaces of the rotating discs 20*a* through 20*k* between the fixed discs 18*a* through 18*l*). This results in some moderate amount of heat transfer between the fixed and rotating discs.

Figure 6C:
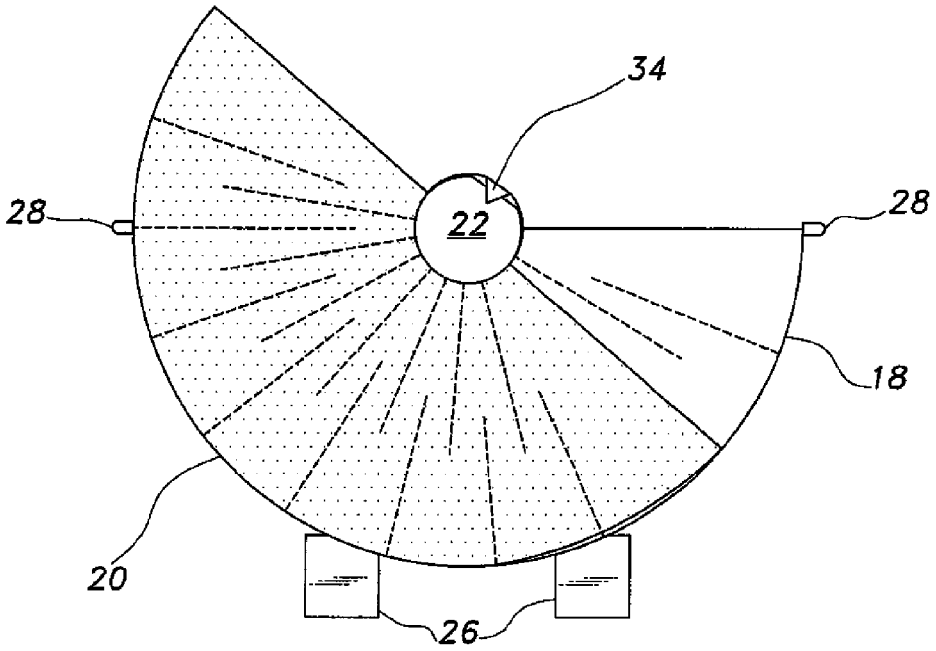
FIG. 6C is an end view of the adjustable heat exchanger of FIG. 1, showing the rotary discs having the majority of their areas interleaved with the stationary discs for relatively high heat transfer therebetween.
Figure 6D:
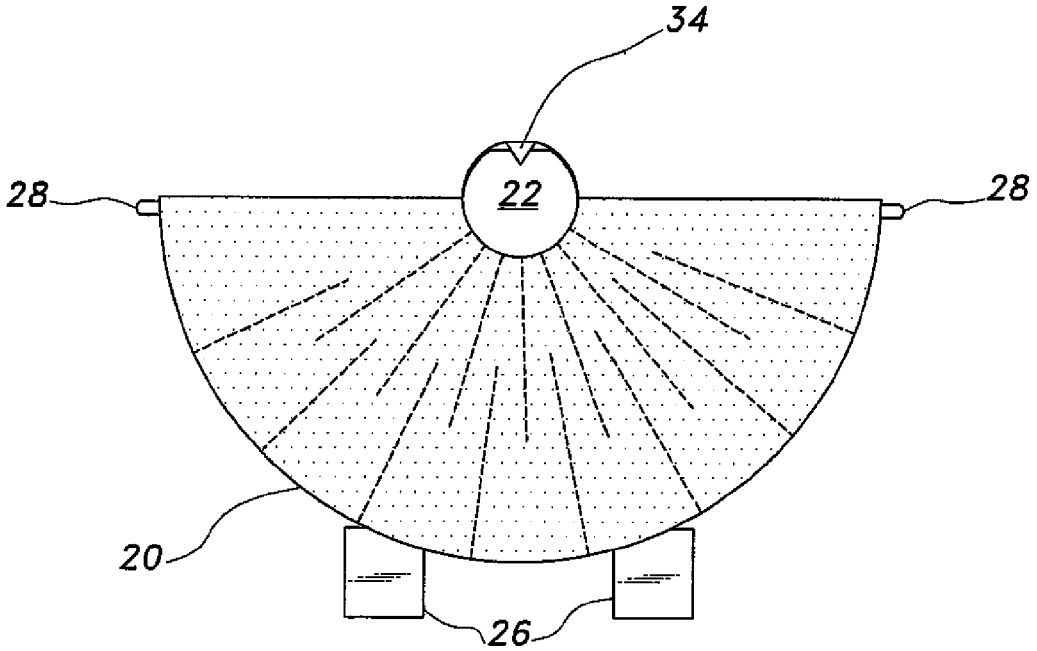
FIG. 6D is an end view of the adjustable heat exchanger of FIG. 1, showing the rotary discs completely interleaved with the stationary discs for maximal heat transfer therebetween.

In FIG. 6C, the rotating disc 20 has been rotated through about 150° counterclockwise from the initial position shown in FIG. 6A. This results in about five-sixths of the area of the rotating disc 20 overlapping the fixed disc 18, and thus producing significantly greater heat transfer than that shown in FIG. 6B. Finally, in FIG. 6D the rotating disc 20 has been rotated through 180° from its initial position, shown in FIG. 6A, so that the two discs 18 and 20 completely overlap one another in FIG. 6D. Thus, one hundred percent of their disc surfaces are immediately adjacent one another to produce the maximum amount of heat transfer possible between the two discs.

Returning to FIG. 1, the complete adjustable heat exchanger system is shown diagrammatically. The first or heat source oven 12 provides a source of heat at least slightly greater than that desired for the pyrolysis oven 14. A first heat transfer fluid, e.g., helium gas or a compound, such as lithium-lead (represented by the flow path 64 shown in FIG. 4), flows from a first fluid supply line 66*a* from the first oven 12 by means of a first fluid pump 68*a*, and thence to an inlet line 70*a* to the first fixed disc 18*a*. This fluid flows through the first fixed disc 18*a* following the sinusoidal path illustrated in FIG. 4, and passes to the second fixed disc 18*b* through the peripheral interconnecting tube 28 between the first and second fixed discs 18*a* and 18*b*. The fluid then flows through the sinusoidal path within the second disc 18*b*, thence transferring to the third disc 18*c* by mean of the interconnecting tube between the two discs 18*b* and 18*c*. This flow path continues with the heat transfer fluid flowing through each of the discs in sequence, finally exiting the last fixed disc 18*l* to return to the first oven 12 via the return line 72*a* for reheating in the first oven 12.

A second heat transfer fluid, preferably identical to the first fluid flowing through the first oven 12 and fixed or stationary discs 18*a* through 181, flows from the second or pyrolysis oven 14 by means of a second fluid supply line 66*b* and second pump 68*b*. The pump 68*b* pumps the fluid to the entry port 30 of the rotary shaft 22 through a second fluid inlet line 70*b*. The second heat transfer fluid then flows into the channel 34 of the shaft 22 and outward to the first rotating disc 20*a* through the first outlet passage 36*a* and transfer tube 38*a* adjacent the first baffle 40*a*, shown in FIG. 3 of the drawings. The flow continues in a sinusoidal path defined by the baffles 58*a* and 58*b* as shown in FIG. 4, thence passing through the outlet transfer tube 38*b* and passage 36*b* and back into the channel 34 of the shaft 22 between the first and second channel baffles 40*a* and 40*b*. The flow path continues in the same manner, with the heat transfer fluid flowing progressively through each of the stationary or fixed discs 20*b* through 20*k* in sequence. Finally, the heat transfer fluid flows into the channel 34 of the shaft 22 through the last passage 36*b* between the final channel baffle 40*k* and the radially disposed exit passage 42, as shown in FIG. 3, and out the exit port 44 of the shaft 22 to the second return line 72*b* to flow back to the second or pyrolysis oven 14.

It will be seen that the two heat transfer fluids, i.e., the first fluid that flows through the first oven 12 and the fixed discs 18*a* through 18*l* and the second fluid that flows through the second oven 14 and the rotating discs 20*a* through 20*k*, never mix, but are maintained completely separate from one another. The essentially constant high heat provided by the first or heat source oven 12 is transferred to the first heat transfer fluid and thence to the fixed discs 18*a* through 18*l*, where the variable interleaving of the rotating discs 20*a* through 20*k* with the first discs provides precise control of the temperature of the second heat transfer fluid that circulates through the rotating discs, and thence to the second or pyrolysis oven 14. While the system described above provides very precise control of the heat delivered to the pyrolysis oven, it will be seen that certain modifications may be made to the system. For example, the first or heat source oven may be connected to the rotating disc assembly and the second or pyrolysis oven may be connected to the fixed discs, if desired. Also, it will be seen that the twelve fixed discs 18*a* through 18*l* and the eleven rotating discs 20*a* through 20*k* are exemplary in number, and that a greater (or smaller) number of fixed and rotating discs may be assembled to form the adjustable heat exchanger. Also, while two specific examples of heat exchange fluid have been described herein, it will be seen that numerous other fluids may be used.

It is to be understood that the present invention is not limited to the embodiments described above, but encompasses any and all embodiments within the scope of the following claims.

I claim:

1. An adjustable heat exchanger, comprising:

a plurality of spaced apart, hollow fixed discs, wherein each of the fixed discs is semicircular;

a plurality of spaced apart, movable discs, the movable discs being selectively interleaved with the fixed discs, wherein each of the movable discs is semicircular;

a first heat transfer fluid circulating through the fixed discs; and a second heat transfer fluid circulating through the movable discs.

2. The adjustable heat exchanger according to claim 1, wherein each of the fixed discs has a channel centrally disposed therein, the adjustable heat exchanger further comprising a selectively rotatable shaft disposed within the channels of the fixed discs, the movable discs being affixed to the shaft and rotating between the fixed discs according to rotation of the shaft.

3. The adjustable heat exchanger according to claim 1, further comprising:

a plurality of interconnecting tubes extending peripherally from each of the fixed discs, each of the fixed discs being fluidly connected sequentially with one another by means of the interconnecting tubes; and a shaft disposed axially along the fixed discs, the movable discs extending radially from the shaft, each of the discs having a sinusoidal flow path defined therein and each of the movable discs being fluidly connected sequentially with one another by the shaft, the first heat transfer fluid circulating through the fixed discs in sequence and the second heat transfer fluid circulating through the movable discs in sequence.

4. The adjustable heat exchanger according to claim 1, wherein each of the discs has an inner periphery and an outer periphery, the adjustable heat exchanger further comprising:

a first plurality of baffles disposed within each of the discs in a radial array, each of the first plurality of baffles having an inner end adjacent the inner periphery and an outer end spaced apart from the outer periphery; and a second plurality of baffles disposed within each of the discs in a radial array, each of the second plurality of baffles having an inner end spaced apart from the inner periphery and an outer end adjacent the outer periphery, the first plurality of baffles and the second plurality of baffles being interleaved with one another in an alternating array defining a sinusoidal path therethrough.

5. The adjustable heat exchanger according to claim 1, further comprising:

a first oven communicating fluidly with the plurality of fixed discs;

a first fluid pump disposed between the first oven and the plurality of fixed discs;

a second oven communicating fluidly with the plurality of movable discs; and a second fluid pump disposed between the second oven and the plurality of movable discs.

6. The adjustable heat exchanger according to claim 1, wherein the first and second heat transfer fluids are selected from the group consisting of helium and lithium-lead compound.

7. An adjustable heat exchanger, comprising:

a plurality of spaced apart, hollow fixed discs, each of the discs having a channel centrally disposed therein;

a selectively rotating shaft disposed within the channels of the fixed discs; and a plurality of spaced apart, hollow movable discs affixed to the shaft, the movable discs being selectively interleaved with the fixed discs and rotating between the fixed discs according to rotation of the shaft.

8. The adjustable heat exchanger according to claim 7, further comprising:

a plurality of interconnecting tubes extending peripherally from each of the fixed discs, each of the fixed discs being fluidly connected sequentially with one another by the interconnecting tubes, the movable discs extending radially from the shaft, each of the discs having a sinusoidal flow path therein, each of the movable discs being fluidly connected sequentially with one another by the shaft;

a first heat transfer fluid circulating through the fixed discs in sequence; and a second heat transfer fluid circulating through the movable discs in sequence.

9. The adjustable heat exchanger according to claim 8, wherein the first and second heat transfer fluids are selected from the group consisting of helium and lithium-lead compound.

10. The adjustable heat exchanger according to claim 7, wherein each of the discs is semicircular.

11. The adjustable heat exchanger according to claim 7, wherein each of the discs has an inner periphery and an outer periphery, the adjustable heat exchanger further comprising:

a first plurality of baffles disposed within each of the discs in a radial array, each of the first plurality of baffles having an inner end adjacent the inner periphery and an outer end spaced apart from the outer periphery; and a second plurality of baffles disposed within each of the discs in a radial array, each of the second plurality of baffles having an inner end spaced apart from the inner periphery and an outer end adjacent the outer periphery, the first plurality of baffles and the second plurality of baffles being interleaved with one another in an alternating array defining a sinusoidal path therethrough.

12. The adjustable heat exchanger according to claim 7, further comprising:

a first oven communicating fluidly with the plurality of fixed discs;

a first fluid pump disposed between the first oven and the plurality of fixed discs;

a second oven communicating fluidly with the plurality of movable discs; and a second fluid pump disposed between the second oven and the plurality of movable discs.

13. An adjustable heat exchanger, comprising:

a first plurality of spaced apart, hollow discs;

a plurality of interconnecting tubes extending peripherally from each of the discs of the first plurality of discs;

a shaft disposed axially along the first plurality of discs;

a second plurality of spaced apart, hollow discs extending radially from the shaft, the second plurality of discs being selectively interleaved with the first plurality of discs, each of the discs having a sinusoidal flow path therein and each of the first plurality of discs being fluidly connected sequentially with one another by the interconnecting tubes, each of the second plurality of discs being fluidly connected sequentially with one another by the shaft;

a first heat transfer fluid circulating through the first plurality of discs in sequence; and a second heat transfer fluid circulating through the second plurality of discs in sequence.

14. The adjustable heat exchanger according to claim 13, wherein:

each of the discs of the first plurality of discs is fixed and has a channel centrally disposed therein, the shaft being disposed rotationally within the channels of the first plurality of discs; and each of the discs of the second plurality of discs is affixed to the shaft, the second plurality of discs being selectively rotatable between the first plurality of discs according to rotation of the shaft.

15. The adjustable heat exchanger according to claim 13, wherein each of the discs is semicircular.

16. The adjustable heat exchanger according to claim 13, wherein each of the discs has an inner periphery and an outer periphery, the adjustable heat exchanger further comprising:

a first plurality of baffles disposed within each of the discs in a radial array, each of the first plurality of baffles having an inner end adjacent the inner periphery and an outer end spaced apart from the outer periphery; and a second plurality of baffles disposed within each of the discs in a radial array, each of the second plurality of baffles having an inner end spaced apart from the inner periphery and an outer end adjacent the outer periphery, the first plurality of baffles and the second plurality of baffles being interleaved with one another in an alternating array defining a sinusoidal path therethrough.

17. The adjustable heat exchanger according to claim 13, further comprising:

a first oven communicating fluidly with the first plurality of discs;

a first fluid pump disposed between the first oven and the first plurality of discs;

a second oven communicating fluidly with the second plurality of discs; and a second fluid pump disposed between the second oven and the second plurality of discs.

18. The adjustable heat exchanger according to claim 13, wherein the first and second heat transfer fluids are selected from the group consisting of helium and lithium-lead compound.

* * * * *